US012728975B2

(12) United States Patent
Turunen et al.

(10) Patent No.: US 12,728,975 B2
(45) Date of Patent: Sep. 8, 2026

(54) ARRANGEMENT AND METHOD FOR SEALING A PROPELLER SHAFT OF A MARINE VESSEL

(71) Applicant: ABB Oy, Helsinki (FI)

(72) Inventors: Ari Turunen, Helsinki (FI); Antti Kopsa, Espoo (FI); Aulis Ollikainen, Mäntsälä (FI)

(73) Assignee: ABB Oy, Helsinki (FI)

( * ) Notice: Subject to any disclaimer, the term of this patent is extended or adjusted under 35 U.S.C. 154(b) by 923 days.

(21) Appl. No.: 18/047,557

(22) Filed: Oct. 18, 2022

(65) Prior Publication Data

US 2023/0117832 A1 Apr. 20, 2023

(30) Foreign Application Priority Data

Oct. 18, 2021 (EP) ..... 21203107

(51) Int. Cl.
*B63H 23/32* (2006.01)
*B63H 23/34* (2006.01)

(52) U.S. Cl.
CPC ..... *B63H 23/321* (2013.01); *B63H 23/34* (2013.01); *B63H 2023/322* (2013.01); *B63H 2023/327* (2013.01)

(58) Field of Classification Search
CPC ..... B63H 23/32; B63H 23/34; B63H 23/36; B63H 2023/321; B63H 2023/322; B63H 2023/323; B63H 2023/325; B63H 2023/327; F16J 15/3204; F16J 15/324; F16J 15/54; F16N 7/36
USPC ..... 440/78, 79, 83, 112
See application file for complete search history.

(56) References Cited

U.S. PATENT DOCUMENTS 5,137,116 A * 8/1992 Von Bergen ..... F16J 15/46 184/104.1
5,492,492 A * 2/1996 Von Bergen ..... F16J 15/3224 277/504
8,690,162 B2 * 4/2014 Chang ..... B63H 23/321 277/633

FOREIGN PATENT DOCUMENTS

EP 3425243 A1 1/2019
KR 1020160027908 A 3/2016
KR 1020190048433 A 5/2019
WO 2016071565 A1 5/2016

OTHER PUBLICATIONS

European Search Report; Application No. EP 21 20 3107; Issued: Apr. 14, 2022; 2 Pages.

(Continued)

*Primary Examiner* — Daniel V Venne
(74) *Attorney, Agent, or Firm* — Greenberg Traurig, LLP

(57) ABSTRACT

An arrangement and a method for sealing a propeller shaft of a marine vessel. The arrangement includes a propeller shaft rotatable supported with at least one bearing, a bearing arrangement, a first lubrication arrangement including a first lubricant circulation line for conducting first lubricant to and from the bearing arrangement, a shaft seal arrangement for sealing the propeller shaft against sea water, and a second lubrication arrangement including a second lubricant circulation line for conducting second lubricant to and from the shaft seal arrangement. A first heat exchanger is in thermal contact with the first lubricant circulation line and in thermal contact with the second lubricant circulation line.

18 Claims, 2 Drawing Sheets

(56) References Cited

OTHER PUBLICATIONS

Chinese Office Action; Application No. 2022112683314; Completed: Apr. 26, 2024; 18 Pages.

* cited by examiner

ARRANGEMENT AND METHOD FOR SEALING A PROPELLER SHAFT OF A MARINE VESSEL

TECHNICAL FIELD

The invention relates to an arrangement for sealing a propeller shaft of a marine vessel wherein the arrangement comprising a propeller shaft rotatable supported with at least one bearing a bearing arrangement adjacent to said at least one bearing, a first lubrication arrangement comprising a first lubricant circulation line for conducting first lubricant to said bearing arrangement and for conducting first lubricant from said bearing arrangement, and a first lubricant circulator configured to create a flow of first lubricant in the first lubricant circulation line and in said bearing arrangement, a shaft seal arrangement for sealing the propeller shaft against sea water, and a second lubrication arrangement comprising a second lubricant circulation line for conducting second lubricant to said shaft seal arrangement and for conducting second lubricant from said shaft seal arrangement, and a second lubricant circulator configured to create a flow of second lubricant in the second lubricant circulation line and in said shaft seal arrangement. The invention also relates to a method for sealing a propeller shaft of a marine vessel with a seal arrangement comprising at least one bearing for rotatable supporting the propeller shaft, a bearing arrangement adjacent to said at least one bearing, a first lubrication arrangement comprising a first lubricant circulation line for conducting first lubricant to said bearing arrangement and for conducting first lubricant from said bearing arrangement, a first lubricant circulator configured to create a flow of first lubricant in the first lubricant circulation line and in said bearing arrangement, a shaft seal arrangement for sealing the propeller shaft against sea water, and a second lubrication arrangement comprising a second lubricant circulation line for conducting second lubricant to said shaft seal arrangement and for conducting second lubricant from said shaft seal arrangement, a second lubricant circulator configured to create a flow of second lubricant in the second lubricant circulation line and in said shaft seal arrangement.

BACKGROUND

Publication WO 2016/071565 presents a method and an arrangement according to the claims.

Raising of the temperature of the lubricant in the shaft seal arrangement both consumes lubricant that is used in the shaft seal arrangement and results in wear of the shaft seal arrangement.

SUMMARY

The object of the invention is to provide a method and an arrangement that lowers the temperature of the temperature of the lubricant in the shaft seal arrangement and that consequently lowers the consumption of lubricant that is used in the shaft seal arrangement and that consequently lowers the wear of the shaft seal arrangement.

The arrangement of the invention, preferred embodiments of the arrangement, the method of the invention, and preferred embodiments of the method are defined in claims.

BRIEF DESCRIPTION OF THE DRAWINGS

In the following the invention will be described in more detail by referring to the figures, of which

DETAILED DESCRIPTION

First the arrangement for sealing a propeller shaft 1 of a marine vessel (not illustrated in the figures) and some embodiments and variants will be described in greater detail.

Figure 1:
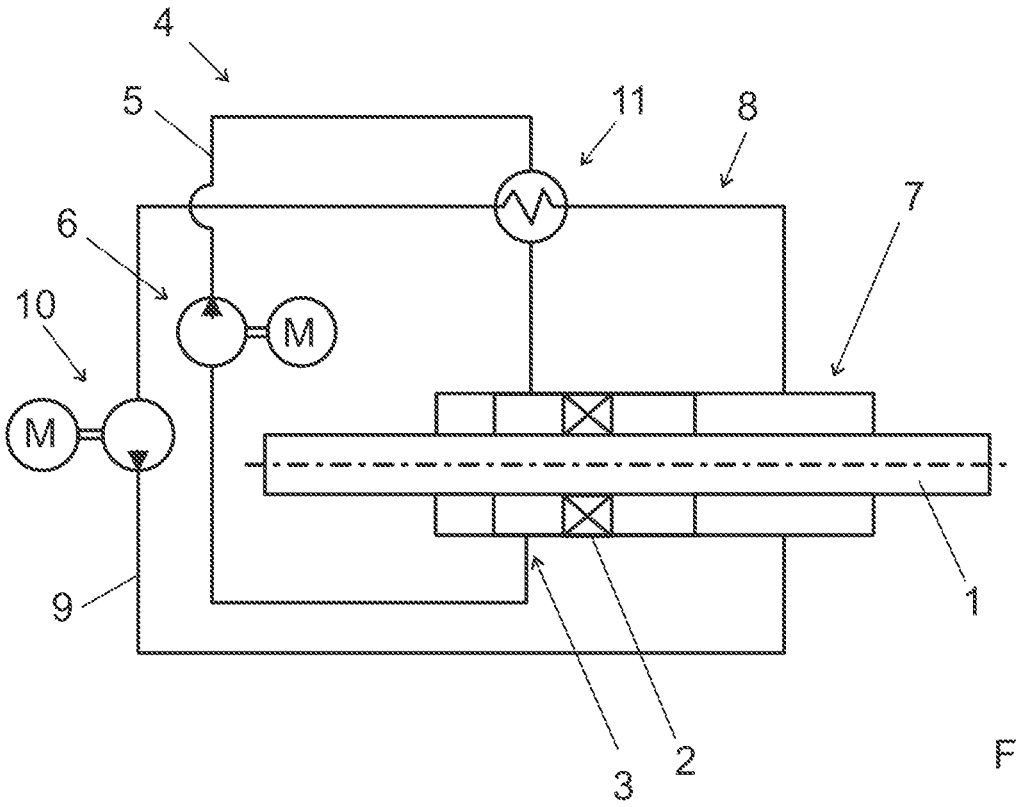
FIG. 1 illustrates an embodiment of the arrangement for sealing a propeller shaft.
Figure 2:
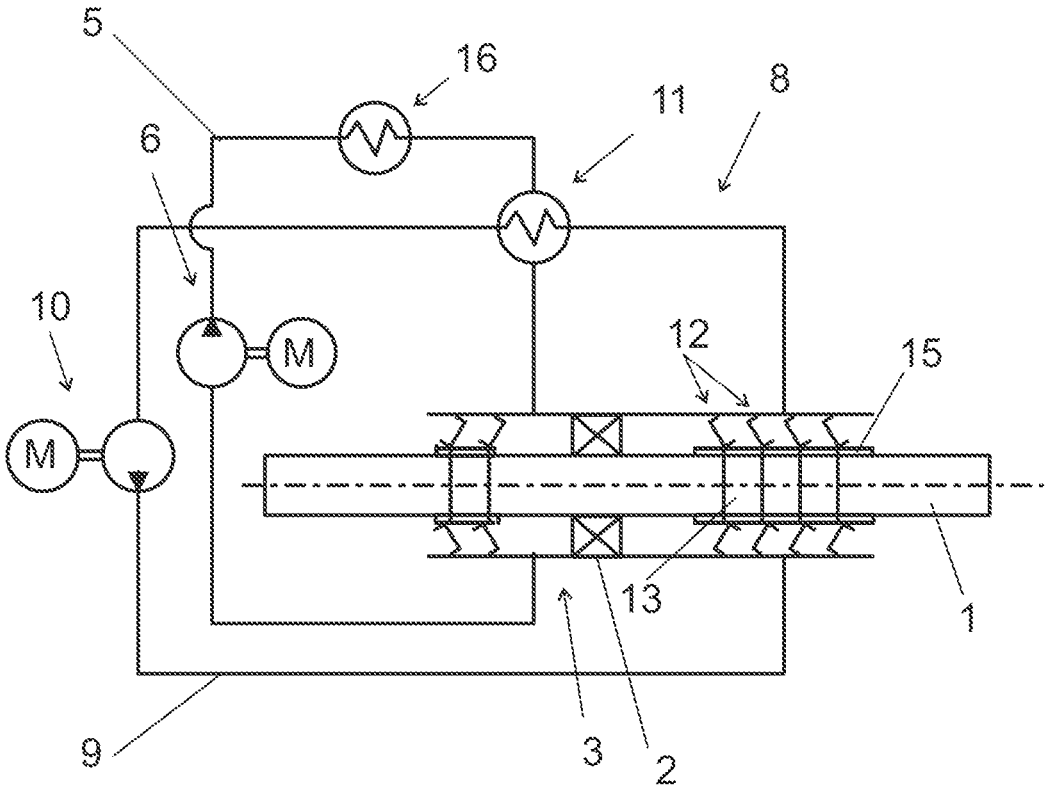
FIG. 2 illustrates another embodiment of the arrangement for sealing a propeller shaft.
Figure 3:
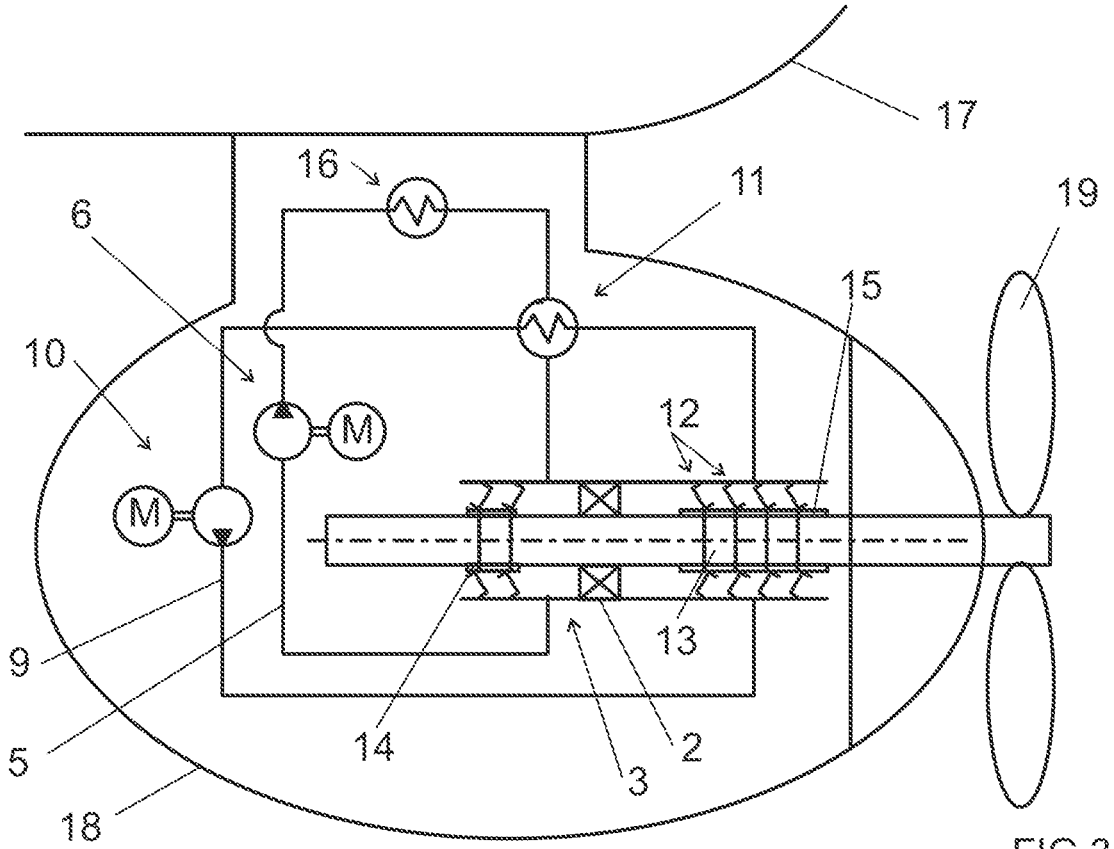
FIG. 3 illustrates yet another embodiment of the arrangement for sealing a propeller shaft.
Figure 4:
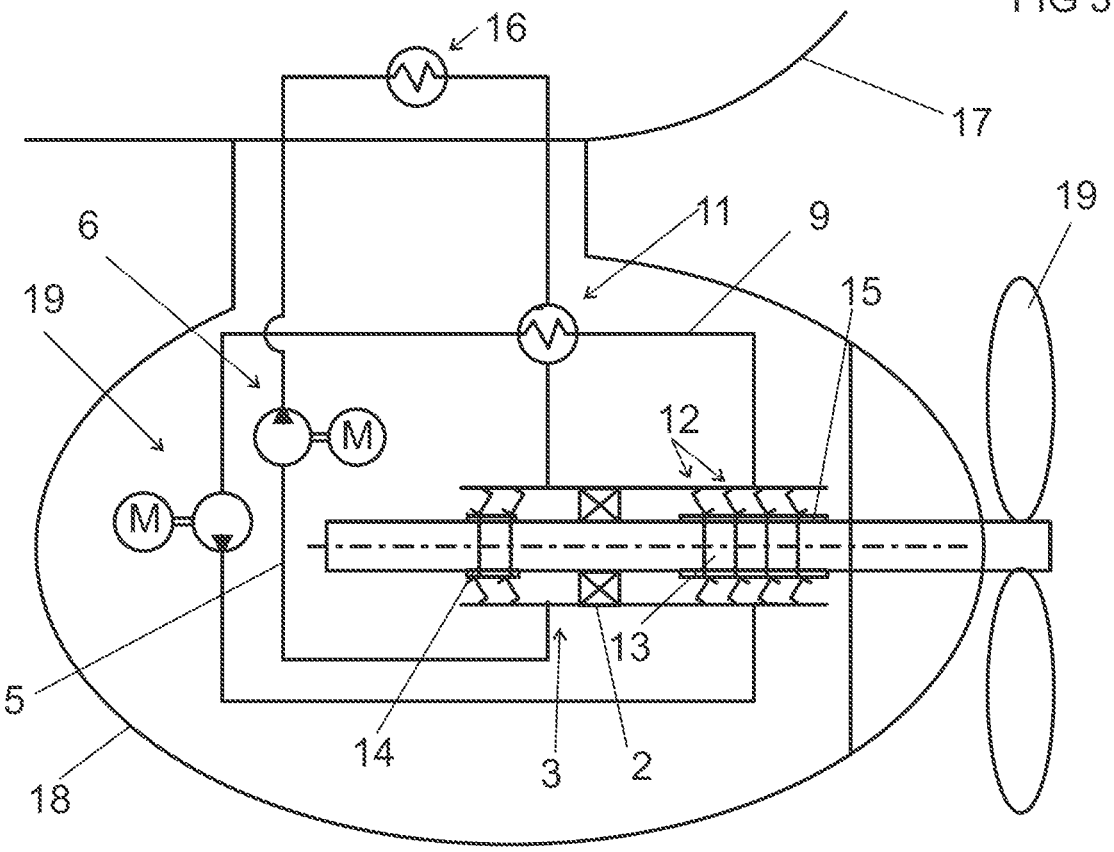
FIG. 4 illustrates still embodiment of the arrangement for sealing a propeller shaft.

The propeller shaft 1 can be arranged at a hull 17 of a marine vessel such as at a ship or at a propulsion unit 18 such as at an azimuthing podded propulsor that is arranged at a hull 17 of a marine vessel such as at a ship, as illustrated in FIGS. 3 and 4.

If the propeller shaft 1 is arranged at a hull 17 of a marine vessel, the propeller shaft has a first portion (not illustrated) that penetrates out of the hull 17 of the marine vessel into sea water when the marine vessel floats in sea water and to which first portion at least one propeller 19 is attached and a second portion (not illustrated) that is within the hull 17 of the marine vessel and to which second portion a drive means for rotating the propeller shaft 1 is functionally connected.

If the propeller shaft 1 is arranged at a propulsion unit 18 that is arranged hull 17 of a marine vessel, the propeller shaft has a first portion that penetrates out of a shell structure of the propulsion unit 18 into sea water when the marine vessel floats in sea water and to which first portion at least one propeller 19 is attached and a second portion that is within the shell structure of the propulsion unit 18 and to which second portion a drive means for rotating the propeller shaft 1 is functionally connected.

The propeller shaft 1 is rotatable supported with at least one bearing 2.

The arrangement comprises a bearing arrangement 3 adjacent to said at least one bearing 2. The bearing arrangement 3 can comprises a bearing housing (not marked with a reference number) encapsulating said at least one bearing 2.

The arrangement comprises a first lubrication arrangement 4 comprising a first lubricant circulation line 5 for conducting first lubricant (not illustrated in the figures) to said bearing arrangement 3 and for conducting first lubricant from said bearing arrangement 3, and a first lubricant circulator 6 configured to create a flow of first lubricant in the first lubricant circulation line and in said bearing arrangement 3. If the bearing 3 arrangement comprises a bearing housing 2 encapsulating said at least one bearing 2, the first lubricant circulation line 5 for conducting first lubricant to said bearing arrangement 3 and for conducting first lubricant from said bearing arrangement can be configured to conduct first lubricant into said bearing housing and be configured to conduct first lubricant from said bearing housing and the first lubricant circulator 6 configured to create a flow of first lubricant in the first lubricant circulation line and in said bearing arrangement 3 can be configured to create a flow of lubricant in said bearing housing.

The arrangement comprises a shaft seal arrangement 7 for sealing the propeller shaft 1 against sea water.

The arrangement comprises a second lubrication arrangement 8 comprising a second lubricant circulation line 9 for conducting second lubricant (not illustrated in the figures) to said shaft seal arrangement 7 and for conducting second lubricant from said shaft seal arrangement 7, and a second lubricant circulator 10 configured to create a flow of second lubricant in the second lubricant circulation line 9 and in said shaft seal arrangement 7.

The arrangement comprises a first heat exchanger 11 in thermal contact with the first lubricant circulation line 5 and in thermal contact with the second lubricant circulation line 9 for transferring thermal energy between first lubricant flowing in the first lubricant circulation line 5 and second lubricant flowing in the second lubricant circulation line 9.

In some embodiments and variants of the arrangement, the first lubricant circulator 6 is a first pump.

The outer circumference of the propeller shaft 1 can have a first liner 14 at the bearing arrangement 3.

The shaft seal arrangement 7 can in some embodiments and variants of the arrangement comprise a plurality a plurality of seal rings 12 axially spaced apart from each other and engaging the outer circumference of the propeller shaft 1 such that at least one lubricant seal chamber 13 is delimited between adjacent seal rings 12 and the outer circumference of the propeller shaft 1. In such embodiments and variants of the arrangement, the second lubricant circulation line 9 for conducting second lubricant to said shaft seal arrangement 7 and for conducting second lubricant from said shaft seal arrangement 7 is configured to conduct second lubricant to said at least one lubricant seal chamber 13 and is configured to conduct second lubricant from said at least one lubricant seal chamber 13. In such embodiments and variants of the arrangement, the second lubricant circulator 10 configured to create a flow of second lubricant in the second lubricant circulation line 9 and in said shaft seal arrangement 7 is configured to create a flow of second lubricant in the second lubricant circulation line 9 and in said at least one lubricant seal chamber 13. In such embodiments and variants of the arrangement, at least one of the seal rings 12 can comprise second seal lips.

In some embodiments and variants of the arrangement, the second lubricant circulator 10 is a second pump.

The outer circumference of the propeller shaft 1 can have a second liner 15 at the shaft seal arrangement 7.

First lubricant flowing in the first lubricant circulation line 5 is preferably, but not necessarily, prevented from mixing with second lubricant flowing in the second lubricant circulation line 9 in the first heat exchanger 11.

This allows to use as the first lubricant a lubricant that has a composition that is different from the composition of the second lubricant.

First lubricant flowing in the first lubricant circulation line 5 is preferably, but not necessarily, prevented from flowing into the second lubricant circulation line 9 in the first heat exchanger 11.

This allows to use as the first lubricant a lubricant that has a composition that is different from the composition of the second lubricant.

Second lubricant flowing in the second lubricant circulation line 9 is preferably, but not necessarily, prevented from flowing into the first lubricant circulation line 5 in the first heat exchanger 11.

This allows to use as the first lubricant a lubricant that has a composition that is different from the composition of the second lubricant. The purity requirement for the first lubricant for the bearing 2 is for example higher than the purity requirement for the second lubricant for the shaft seal arrangement 7.

The first lubricant is preferably a lubricant that has a composition that is different from the composition of the second lubricant. The purity requirement for the first lubricant for the bearing 2 is for example higher than the purity requirement for the second lubricant for the shaft seal arrangement 7. The viscosity of the second lubricant that is used in the shaft seal arrangement 7 is also normally higher than the viscosity of the first lubricant that is used in the bearing 2.

The arrangement can comprise a second heat exchanger 16 in thermal contact with the first lubricant circulation line 5, wherein the second heat exchanger is configured to transfer thermal energy from first lubricant circulating in the first lubricant circulation line 5 and wherein the second heat exchanger 16 is provided from the first lubricant circulation line 5. If the propeller shaft 1 is arranged at a propulsion unit 18 such as at an azimuthing podded propulsor that is arranged at a hull 17 of a marine vessel such as at a ship, the second heat exchanger 16 is preferably, but not necessarily, arranged within hull 17 of the ship, outside the propulsion unit 18, as illustrated in FIG. 4. This allows to use a large heat exchanger as the second heat exchanger 16, because there is normally more space within the hull 17 of the ship than in the propulsion unit 18. It is however possible to arrange the second heat exchanger 16 within the propulsion unit 18 as illustrated in FIG. 3.

The first lubricant flows preferably, but not necessarily, through the heat exchanger 11 and that second lubricant flows preferably, but not necessarily, through the heat exchanger 11.

The first lubricant circulation line 5 and the second lubricant circulation line 9 are preferably, but not necessarily, connected to the first heat exchanger 11.

The first lubricant circulation line 5 and the second lubricant circulation line 9 are preferably, but not necessarily, in fluid connection with the first heat exchanger 11.

Next method for sealing a propeller shaft 1 of a marine vessel with a seal arrangement and some embodiments and variants of the method will be described in greater detail.

The propeller shaft 1 can be arranged at a hull 17 of a marine vessel such as at a ship or at a propulsion unit 18 such as at an azimuthing podded propulsor that is arranged at a hull 17 of a marine vessel such as at a ship, as illustrated in FIGS. 3 and 4.

If the propeller shaft 1 is arranged at a hull 17 of a marine vessel, the propeller shaft has a first portion (not illustrated) that penetrates out of the hull 17 of the marine vessel into sea water when the marine vessel floats in sea water and to which first portion at least one propeller 19 is attached and a second portion (not illustrated) that is within the hull 17 of the marine vessel and to which second portion a drive means for rotating the propeller shaft 1 is functionally connected.

If the propeller shaft 1 is arranged at a propulsion unit 18 that is arranged hull 17 of a marine vessel, the propeller shaft has a first portion that penetrates out of a shell structure of the propulsion unit 18 into sea water when the marine vessel floats in sea water and to which first portion at least one propeller 19 is attached and a second portion that is within the shell structure of the propulsion unit 18 and to which second portion a drive means for rotating the propeller shaft 1 is functionally connected.

In the method the propeller shaft 1 rotatable is supported with at least one bearing 2.

In the method the propeller shaft 1 of the marine vessel is sealed with a seal arrangement comprising a bearing arrangement 3 adjacent to said at least one bearing 2.

In the method the propeller shaft 1 of the marine vessel is sealed with a seal arrangement comprising a first lubrication arrangement 4 comprising a first lubricant circulation line 5 for conducting first lubricant to said bearing arrangement 3 and for conducting first lubricant from said bearing arrangement 3, a first lubricant circulator 6 configured to create a flow of first lubricant in the first lubricant circulation line and in said bearing arrangement 3.

If the bearing 3 arrangement comprises a bearing housing 2 encapsulating said at least one bearing 2, the first lubricant circulation line 5 for conducting first lubricant to said bearing arrangement 3 and for conducting first lubricant from said bearing arrangement can be configured to conduct first lubricant into said bearing housing and be configured to conduct first lubricant from said bearing housing and the first lubricant circulator 6 configured to create a flow of first lubricant in the first lubricant circulation line and in said bearing arrangement 3 can be configured to create a flow of lubricant in said bearing housing.

In the method the propeller shaft 1 of the marine vessel is sealed with a seal arrangement comprising a shaft seal arrangement 7 for sealing the propeller shaft 1 against sea water.

In the method the propeller shaft 1 of the marine vessel is sealed with a seal arrangement comprising a second lubrication arrangement 8 comprising a second lubricant circulation line 9 for conducting second lubricant to said shaft seal arrangement 7 and for conducting second lubricant from said shaft seal arrangement 7, a second lubricant circulator 10 configured to create a flow of second lubricant in the second lubricant circulation line 9 and in said shaft seal arrangement 7.

The method comprises providing a first heat exchanger 11 in thermal contact with the first lubricant circulation line 5 and in thermal contact with the second lubricant circulation line 9.

The method comprises transferring thermal energy between first lubricant flowing in the first lubricant circulation line 5 and second lubricant flowing in the second lubricant circulation line 9 by means of the first heat exchanger 11.

This allows to use as the first lubricant a lubricant that has a composition that is different from the composition of the second lubricant. The purity requirement for the first lubricant for the bearing 2 is for example higher than the purity requirement for the second lubricant for the shaft seal arrangement 7. The viscosity of the second lubricant that is used in the shaft seal arrangement 7 is also normally higher than the viscosity of the first lubricant that is used in the bearing 2.

The method comprises preferably, but not necessarily, preventing first lubricant flowing in the first lubricant circulation line 5 from mixing with second lubricant flowing in the second lubricant circulation line 9 in the first heat exchanger 11.

This allows to use as the first lubricant a lubricant that has a composition that is different from the composition of the second lubricant.

The method comprises preferably, but not necessarily, preventing first lubricant flowing in the first lubricant circulation line 5 from flowing into the second lubricant circulation line 9 in the first heat exchanger 11.

This allows to use as the first lubricant a lubricant that has a composition that is different from the composition of the second lubricant.

The method comprises preferably, but not necessarily, preventing second lubricant flowing in the second lubricant circulation line 9 from flowing into the first lubricant circulation line 5 in the first heat exchanger 11.

The method comprises preferably, but not necessarily, using as the first lubricant a lubricant that has a composition that is different from the composition of the second lubricant.

The method comprises preferably, but not necessarily, providing a second heat exchanger 16 in thermal contact with the first lubricant circulation line 5 so that the second heat exchanger 16 is provided from the first lubricant circulation line 5, and transferring thermal energy from first lubricant circulating in the first lubricant circulation line 5 by means of the second heat exchanger 16. If the propeller shaft 1 is arranged at a propulsion unit 18 such as at an azimuthing podded propulsor that is arranged at a hull 17 of a marine vessel such as at a ship, the second heat exchanger 16 is preferably, but not necessarily, arranged within the hull 17 of the ship, outside the propulsion unit 18. as illustrated in FIG. 4. This allows to use a large heat exchanger as the second heat exchanger 16, because there is normally more space within the hull 18 of the ship than in the propulsion unit 18. It is however possible to arrange the second heat exchanger 16 within the propulsion unit 18 as illustrated in FIG. 3.

The first lubricant flows preferably, but not necessarily, through the heat exchanger 11 and that second lubricant flows preferably, but not necessarily, through the heat exchanger 11.

The first lubricant circulation line 5 and the second lubricant circulation line 9 are preferably, but not necessarily, connected to the first heat exchanger 11.

The first lubricant circulation line 5 and the second lubricant circulation line 9 are preferably, but not necessarily, in fluid connection with the first heat exchanger 11.

It is apparent to a person skilled in the art that as technology advanced, the basic idea of the invention can be implemented in various ways. The invention and its embodiments are therefore not restricted to the above examples, but they may vary within the scope of the claims.

The invention claimed is:

1. An arrangement for sealing a propeller shaft of a marine vessel, the arrangement comprising:

a propeller shaft rotatable supported with at least one bearing, a bearing arrangement adjacent to said at least one bearing, a first lubrication arrangement comprising a first lubricant circulation line for conducting a first lubricant to said bearing arrangement and for conducting the first lubricant from said bearing arrangement, and a first lubricant circulator configured to create a flow of the first lubricant in the first lubricant circulation line and in said bearing arrangement, a shaft seal arrangement for sealing the propeller shaft against sea water, and a second lubrication arrangement including a second lubricant circulation line for conducting a second lubricant to said shaft seal arrangement and for conducting the second lubricant from said shaft seal arrangement, and a second lubricant circulator configured to create a flow of the second lubricant in the second lubricant circulation line and in said shaft seal arrangement, wherein:

a first heat exchanger in thermal contact with the first lubricant circulation line and in thermal contact with the second lubricant circulation line for transferring thermal energy between the first lubricant flowing in the first lubricant circulation line and the second lubricant flowing in the second lubricant circulation line, wherein the first heat exchanger transfers the thermal energy to lower a temperature of the second lubricant in said shaft seal arrangement.

2. The arrangement according to claim 1, wherein:

the first lubricant circulator being a first pump.

3. The arrangement according to claim 1, wherein:

the outer circumference of the propeller shaft having a first liner at the bearing seal arrangement.

4. The arrangement according to claim 1, wherein:

the shaft seal arrangement comprising a plurality of seal rings axially spaced apart from each other and engaging the outer circumference of the propeller shaft such that at least one lubricant seal chamber is delimited between adjacent seal rings and the outer circumference of the propeller shaft, the second lubricant circulation line for conducting second lubricant to said shaft seal arrangement and for conducting second lubricant from said shaft seal arrangement being configured to conduct second lubricant to said at least one lubricant seal chamber and being configured to conduct second lubricant from said at least one lubricant seal chamber, and the second lubricant circulator configured to create a flow of second lubricant in the second lubricant circulation line and in said shaft seal arrangement being configured to create a flow of second lubricant in the second lubricant circulation line and in said at least one lubricant seal chamber.

5. The arrangement according to claim 4, wherein:

at least one of the seal rings comprising second seal lips.

6. The arrangement according to claim 1, wherein:

the second lubricant circulator being a second pump.

7. The arrangement according to claim 1, wherein:

the outer circumference of the propeller shaft having a second liner at the shaft seal arrangement.

8. The arrangement according to claim 1, wherein:

first lubricant flowing in the first lubricant circulation line being prevented from mixing with second lubricant flowing in the second lubricant circulation line in the first heat exchanger.

9. The arrangement according to claim 1, wherein:

first lubricant flowing in the first lubricant circulation line being prevented from flowing into the second lubricant circulation line in the first heat exchanger.

10. The arrangement according to claim 1, wherein:

second lubricant flowing in the second lubricant circulation line being prevented from flowing into the first lubricant circulation line in the first heat exchanger.

11. The arrangement according to claim 1, wherein:

the first lubricant being a lubricant that has a composition that is different from the composition of the second lubricant.

12. The arrangement according to claim 1, wherein:

a second heat exchanger in thermal contact with the first lubricant circulation line, wherein the second heat exchanger is configured to transfer thermal energy from first lubricant circulating in the first lubricant circulation line, wherein the second heat exchanger is provided from the first lubricant circulation line.

13. A method for sealing a propeller shaft of a marine vessel with a seal arrangement having:

at least one bearing for rotatable supporting the propeller shaft, a bearing arrangement adjacent to said at least one bearing, a first lubrication arrangement comprising a first lubricant circulation line for conducting a first lubricant to said bearing arrangement and for conducting the first lubricant from said bearing arrangement, a first lubricant circulator configured to create a flow of the first lubricant in the first lubricant circulation line and in said bearing arrangement, a shaft seal arrangement for sealing the propeller shaft against sea water, and a second lubrication arrangement including a second lubricant circulation line for conducting a second lubricant to said shaft seal arrangement and for conducting the second lubricant from said shaft seal arrangement, a second lubricant circulator configured to create a flow of the second lubricant in the second lubricant circulation line and in said shaft seal arrangement, wherein the method comprises:

providing a first heat exchanger in thermal contact with the first lubricant circulation line and in thermal contact with the second lubricant circulation line, and transferring thermal energy between first lubricant flowing in the first lubricant circulation line and second lubricant flowing in the second lubricant circulation line by means of the first heat exchanger, wherein said transferring of thermal energy via the first heat exchanger lowers a temperature of the second lubricant in said shaft seal arrangement.

14. The method according to claim 13, wherein:

preventing first lubricant flowing in the first lubricant circulation line from mixing with second lubricant flowing in the second lubricant circulation line in the first heat exchanger.

15. The method according to claim 13, wherein:

preventing first lubricant flowing in the first lubricant circulation line from flowing into the second lubricant circulation line in the first heat exchanger.

16. The method according to claim 13, wherein:

preventing second lubricant flowing in the second lubricant circulation line from flowing into the first lubricant circulation line in the first heat exchanger.

17. The method according to claim 13, wherein:

using as the first lubricant a lubricant that has a composition that is different from the composition of the second lubricant.

18. The method according to claim 13, wherein:

providing a second heat exchanger in thermal contact with the first lubricant circulation line wherein the second heat exchanger is provided from the first lubricant circulation line, and by transferring thermal energy from first lubricant circulating in the first lubricant circulation line by means of the second heat exchanger.

* * * * *